US006105283A

United States Patent [19]

Park

[11] Patent Number: 6,105,283

[45] **Date of Patent: *Aug. 22, 2000**

[54] SHOE INSOLE FOR CORRECTION, CONTROL, AND UNDERFOOT COMFORT

[76] Inventor: In-sik Park, 847-37, Anyang 2-dong, Manan-gu, Anyang-city, Kyungki-do, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/928,222

[22] Filed: Sep. 12, 1997

[30] Foreign Application Priority Data

Nov. 11, 1996 [KR] Rep. of Korea ..... 96-53313

[51] Int. Cl.[7] ..... A43B 23/00

[52] U.S. Cl. ..... 36/159; 36/43; 36/160

[58] Field of Search ..... 36/43, 155, 159, 36/160, 161

[56] References Cited

U.S. PATENT DOCUMENTS

| | | | |
|---|---|---|---|
| 1,118,736 | 11/1914 | Byrd | 36/155 |
| 2,312,378 | 3/1943 | Baum | 36/155 |
| 2,613,455 | 10/1952 | Amico | 36/155 |
| 2,680,919 | 6/1954 | Riggs | 36/155 |
| 4,841,648 | 6/1989 | Shaffer et al. | 36/43 |
| 5,138,774 | 8/1992 | Sarkozi | 36/160 X |
| 5,799,414 | 9/1998 | Kellerman | 36/44 |

FOREIGN PATENT DOCUMENTS 4-97701 3/1992 Japan .

*Primary Examiner*—Paul T. Sewell
*Assistant Examiner*—Jila Mohandesi
*Attorney, Agent, or Firm*—Wood, Philips, VanSanten, Clark & Mortimer

[57] ABSTRACT

An orthoinsert for shoes to control and correct many types of abnormally functioning feet. The orthoinsert comprises an insole plate which has the full length of an entire foot or a length corresponding to the length of an insole except the forefoot part, an arch filler and a heel site for holding the heel in well-aligned position. The arch filler and the heel site are integrated with the plate. A forefoot wedge is attached to the fore part of the undersurface of the insole plate to control the angle of the forefoot to the ground surface. A rearfoot wedge is attached to the rear part of the undersurface of the insole plate to control and correct the angle of the rearfoot to the ground surface to provide and achieve a total underfoot comfort during walking. Three types of orthoinsert accommodate semipronated, oversupinated and hyperpronated feet.

3 Claims, 3 Drawing Sheets

SHOE INSOLE FOR CORRECTION, CONTROL, AND UNDERFOOT COMFORT

FIELD OF THE INVENTION

The present invention relates to a set of shoe inserts, and more particularly, to a set of orthoinserts for allowing an easy application for many types of abnormal feet and an easy control of the angle of an insole plate to the ground by a forefoot wedge and a rearfoot wedge in order to provide better underfoot comfort and control when wearing sporting and walking shoes.

DESCRIPTION OF THE RELATED ART

The foot contacts the ground and supports the weight of a body when standing, and allows to walking or exercising by appropriate and flexible movements of its bones and muscles. As a result, it is necessary to redistribute the pressure of the body weight by the even contact of the entire plantar surface of the foot to the ground.

Generally, the plantar surface of normal feet with three arches contacts the ground evenly to provide stable standing. When walking or running, the arches absorb the ground reaction force functioning like a spring and allowing the whole foot to move in a heel-to-toe motion freely providing easy and stable sagittal movements of body.

The normal foot, biomechanically, has 8 to 12 degrees of functional movement ranges from the sum of the movements of its supination and pronation around the longitudinal axis of the subtalar joint, each of which has 4 to 6 degrees. In general, human feet and their ambulation can be classified into three distinctive shapes, foot supination (pes cavus), wherein foot moves to the direction of inversion, adduction, and plantar flexion, and foot pronation (pes planus), wherein the foot moves to the direction of eversion, abduction, and dorsiflexion, and the normal foot (pes rectus), wherein the foot has a very good alignment to the ground.

However, the abnormal foot, such as an oversupinated foot, slightly pronated foot, hyperpronated foot,etc. usually cause functional problems and pain when walking and standing as well as running and heavy exercise.

Accordingly, there has been an increasing demand for design and development of sport shoes for better fitting.

For example, last construction has been changed with straight lasted shoes for hyperpronated foot, semi-curved shoes for normal foot and curved lasted shoe construction for supinating foot, etc. However, shoe construction cannot change abnormal function of the foot. Furthermore, it may be the shoes which causes foot injuries by wearing a wrong pair of shoes. Moreover the shoes have expensive prices.

Generally, in order to make custom-made shoes and orthoses for foot correction, a cast is taken of a foot using plaster bandages, and then custom-made orthoses or insoles are made by molding over the plaster foot, cast with synthetic resins or any appropriate materials.

However, orthoses requires too much time and often complicated procedure to make and they are also too expensive to use.

Moreover, it is impossible to mass produce orthoses because they are supposed to be made for one specific foot and they also require proper adjustment to change their shape.

Japan Patent Office Publication No. Hei 4-97701 describes an insole for ski boots, wherein the thickness of the fore part and the rear part of the insole is different from each other depending on the pressure difference applied on each of them.

However, this process is done by analyzing the foot pressure distribution of the specific foot and determining the appropriate thickness of the insole according to the individual measurements to thereby make the corresponding insole thereto while still having the problems described above.

Chattanooga Corporation located in U.S.A. manufactures premolded devices as seen in FIG. 1 under the registered trademark of 'Viscolas', the insole comprising a pair of flat insole plates 1 following the shape of sole, a pair of longitudinal arch pads 2, a pair of heel wedges 3, a large and a small metatarsal pad 4, a neuroma pad 5, and a toe crest pad 6. The wedge has somehow different thickness on its ends, but the incline angle between its ends is not restricted to a specific angle with its inclined shape characteristics. The pads 2, 4, 5 and 6 have an even thickness and are attached on the insole plate 1 being used to adjust the thickness of the insole plate 1 or the gap between the insole plate 1 and sole. The above-described insoles compensate the uneven contact to the ground surface by attaching the wedges or the pads on the insole plate 1 so as to mass produce the insoles. However, there is still a problem in fitting the insole on many different types of feet because various parameters should be considered when these wedges and pads are applied on the insole, not only the adhesive site or their thickness but structural or anatomical foot variance. Moreover, it is almost impossible to control the angle to the ground surface with hyperpronated, oversupinated or semipronated feet.

Professional Protective Technology of the Langer Group in U.S.A. also manufactures preformed insoles under the trade mark of Temppthotics as seen in FIG. 2. The insole comprises a pair of flat insole plates 1 which have a convex shape corresponding to the arch of sole, a pair of forefoot pads 7 accompanying each of the insole plates, a pair of rearfoot pads 8, a pair of longitudinal pads 2, and a pair of auxiliary pads 9.

These pads are to be attached on the insole plates 1 to compensate the uneven contact of the foot to the ground surface thereby making it possible to mass produce them. However, it also has problems in fitting the insole on a certain foot because many parameters should be considered when these pads are attached on the insole plate 1, and moreover it is almost impossible to control the foot angle to the ground surface with semipronating or hyperpronating or over supinating feet.

Therefore, there is a strong demand for the development of a shoe insole (orthoinsert) which provides an easy application on sport and walking shoes or means of foot correction and underfoot comfort for the abnormal foot classified according to the function and shape such as semipronating type, supinating type and hyperpronating type.

SUMMARY OF THE INVENTION

The present invention directed to an orthoinsert for allowing an easy application for many types of abnormal foot function such as oversupination, semipronation, and hyperpronation,etc. Biomechanically, orthoinserts can be used to correct many foot alignment problems such as forefoot invertus, forefoot evertus, rearfoot varus, rearfoot valgus, plantar flexed or dorsiflexed first metatarsus, etc.

The insole of the present invention comprises three pair of different insole plate types which can have the full length of the entire sole for sport shoes or walking shoes or the length corresponding to the length of the heel-to-metatarsal head with an arch supporting lesion to match the arch of foot with varying heights, a heel site for stabilizing the calcaneus of the foot. Furthermore, adhesive and adjustable forefoot wedges are attached on the forepart of the undersurface of the orthoinserts to control the angle of the forefoot to the ground surface, and adhesive and adjustable rearfoot wedges are attached on the rearpart of the undersurface of orthoinserts to correct the angle of the rear part of a foot to the ground surface. The insole plate, the arch filler, and the heel site are integrated.

The insole plates can have foot classified and preformed shapes depending on the abnormal foot type, such as semipronated foot, oversupinated foot, hyperpronated foot, and the like.

Primarily, among the above abnormal foot types, the insole for the oversupinated foot may include the first metatarsus and medial cuneiform accommodation which is incarved where the first metatarsus and its contacting first cuneiform meet. Preferably, the insole for the oversupinated foot may include both the first-inclined site and a cut for the first metatarsal head.

In addition, the hyperpronating type insole plate is such a manner further characterized in such a manner that a medially inclined angle is formed on the heel site with a constant inclination following the shape of the foot. An inverted angle is added to the above angle around the longitudinal axis of the midtarsal joint of the foot so that the midpart of the insole has the highest arch filler.

Finally, the semipronating type orthoinsert has a medially inscribed varus angle on its heel and the forefoot and rearfoot angles can be altered accordingly.

Foot angles are constantly proportional and changeable to the heel site by using wedges.

One end of the forefoot wedge attached on the insole plate is round-edge finished so as to have a similar shape with the forepart of the insole plate, wherein a plurality of control lines are formed on the surface of the forepart of the insole plate. As each line is spaced in a constant interval apart longitudinally so that the selection of any one of the control lines provides the control of the angle of the forepart of the insole plate to the ground surface.

By using the above control lines of the forefoot wedge, the range of the forepart angle of the insole plate to the ground surface can be adjusted from 0.5 to 10 degrees, and preferably 2 to 3 degree.

In addition, one end of the rearfoot wedge attached to the insole plate is round-edge finished so as to have a similar shape with the rearpart of the insole plate, wherein a plurality of control lines are formed on the surface of the rearpart of the insole plate with each line spaced a constant interval apart longitudinally so that the selection of any one of the control lines provides the angle control of the rear half insole plate to the ground surface. By the above control lines of the rearfoot wedge, the angle range of the rearpart of the insole plate to the ground surface can be adjusted from 0.5 to 10 degrees, and preferably 2 to 3 degree.

The control lines of the rearfoot wedge are formed so as to have an arc having the same diameter as the corner of the rearfoot wedge of the insole plate.

It is to be understood that both the foregoing general description and the following detailed description are exemplary and explanatory and are intended to provide further explanation of the invention as claimed.

DETAILED DESCRIPTION OF THE PREFERRED EMBODIMENTS

Figure 1:
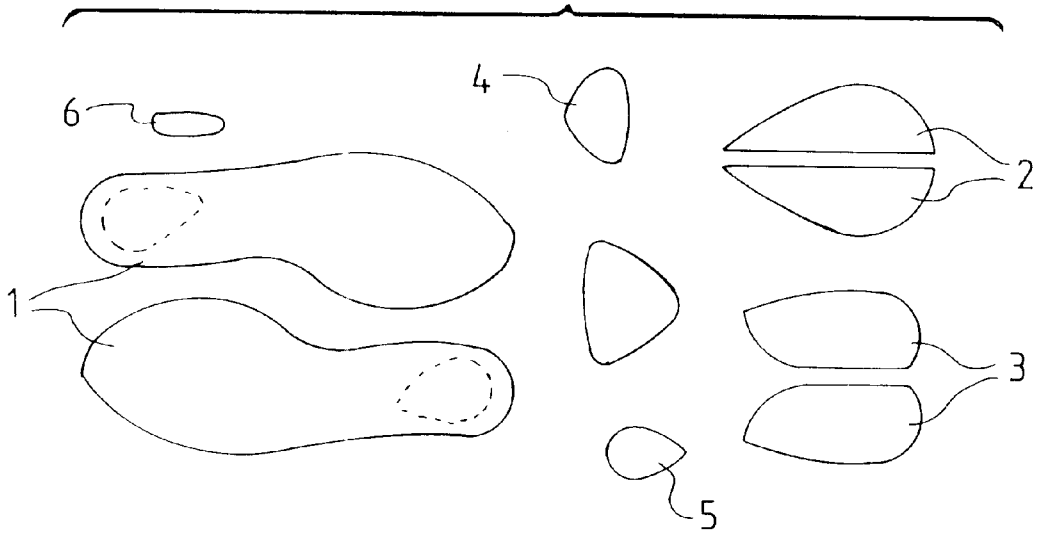
FIG. 1 PRIOR ART
FIG. 1 is a schematic plan view of an embodiment of the conventional preformed insoles.
Figure 2:
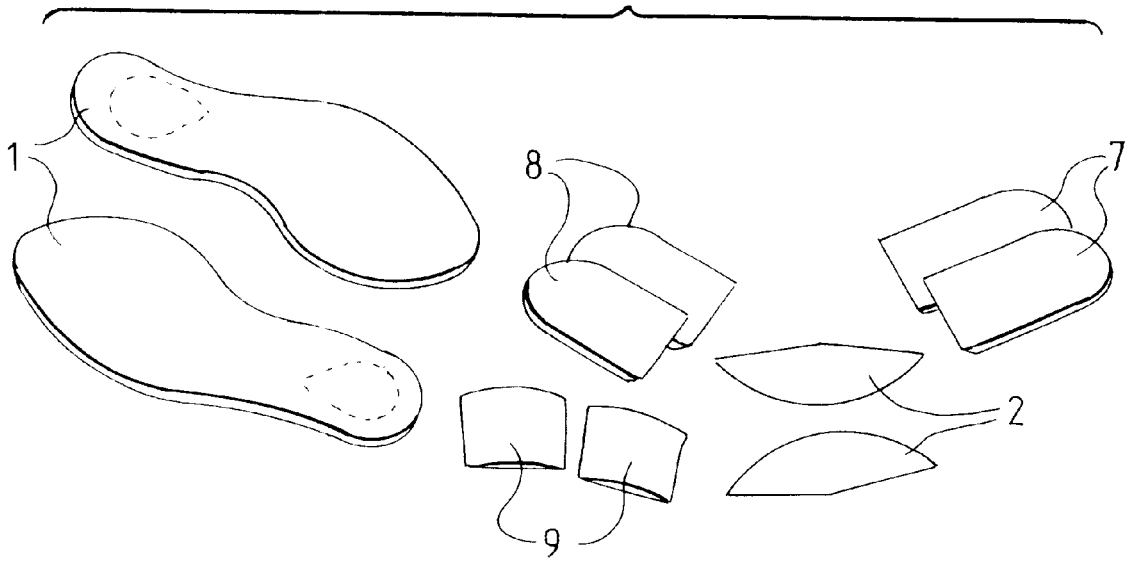
FIG. 2 PRIOR ART
FIG. 2 is a schematic plan view of another embodiment of the conventional premoulded insoles.
Figure 3:
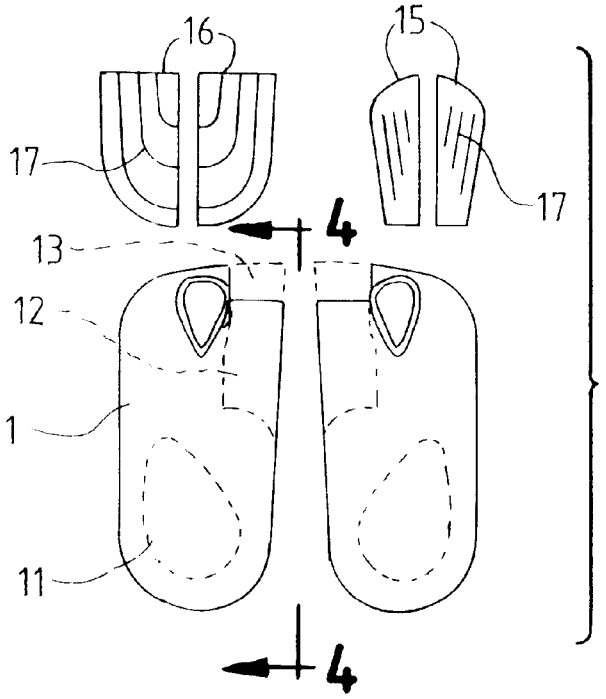
FIG. 3 is a schematic plan view of an embodiment of the orthoinsert according to the present invention.
Figure 4:
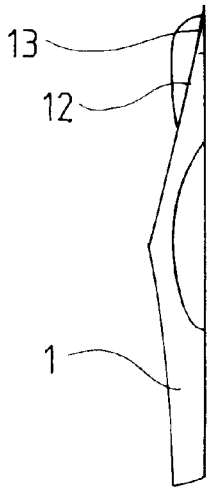
FIG. 4 is a cross-sectional view of the orthoinsert of shown in FIG. 3.
Figure 5:
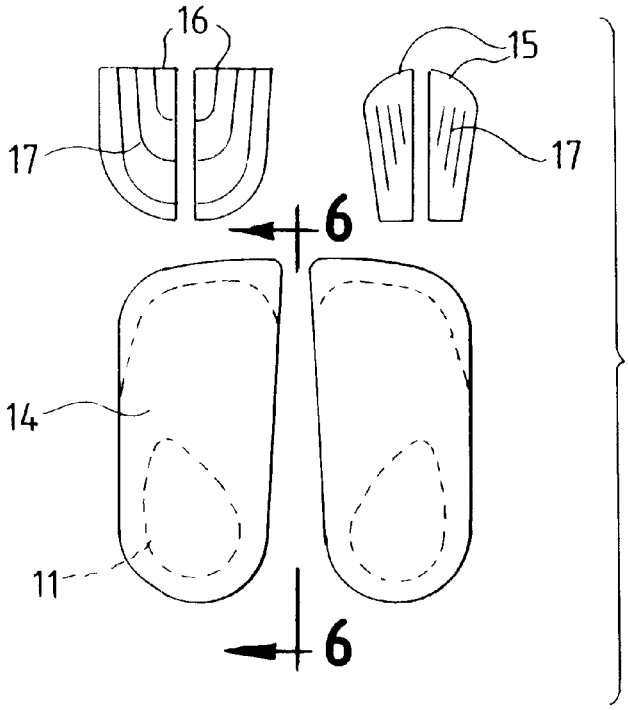
FIG. 5 is a schematic plan view of another embodiment of the orthoinsert for hyperpronated foot according to the present invention.

Reference will now be made in detail to the preferred embodiments of the present invention, examples of which are illustrated in the accompanying drawings.

As seen in FIGS. 3 to 6, the orthoinserts of the present invention comprise a pair of shell plates 1, forefoot wedges 15 and rearfoot wedges 16, both of which are attached on the shell plates. The shell plate 1 can be a full length of an entire sole from the heel end to the toe end to replace the conventional shoe innersoles, or a length corresponding to the length of the sole except the forefoot part. The length must be appropriately controlled or precut for a pair of certain shoes depending on certain shoe design.

The shell plates have arch fillers 10*a*, 10*b* corresponding to the foot arches holding the heel accordingly, all of which are integrated with three types of shells. Orthoinserts are generally mass produced by injection moulding method or extrusion moulding method, etc. by using synthetic resin or other appropriate materials.

In addition, the forefoot wedge 15 attached on the fore part of the undersurface of the shell plate 1 can be used as means for controlling the angle of the forefoot to the ground surface by controlling the angle of its inclination or declination. The forefoot wedge can be made of a plate wedge in such a manner that one end is thick and the other end is thin. The material for the forefoot wedge is the same as that of the shell plate 1.

A rearfoot wedge 16 attached on the rear part of the undersurface of the shell plate 1 can be used as means for controlling the angle of the rearfoot to the ground surface by controlling the angle of its inclination or declination which is understood to have the same function as the forefoot wedge 15 or similar thereto.

Specifically, since the rearfoot wedge 16 is directly placed under the heel site, it may have a wide space compared with the forefoot wedge 15, and preferably, it can have the space over the three quarter of width of the rear part of the shell plate 1.

The angle of the shell plates to the ground can be controlled by the application of the forefoot wedges 15 and the rearfoot wedges 16. Accordingly, the shell plates can be attached on the midsole of the shoes depending on the shoe manufacturer's choice. Shoe and orthoinserts function together to distribute the whole weight of the body correctly to the ground when applied on each of three abnormal foot shapes, such as semipronated, oversupinated, and hyperpronated feet.

In order to achieve total underfoot comfort, the shell design must be classified and preformed shell shapes provided for each abnormal foot type. The shell plates should be directly and easily applied to the foot. Each shell type has a plurality of shells of varied length.

Among the above orthoinsert types, the insole for the supinated foot may include a first metatarsus accommodative site 12 which is incarved where the first metatarsus and its contacting first cuneiform meet, or a cut 13 which is cut in the interface of the first metatarsus and the first phalange. The application of the first metatarsus accommodative site 12 is the main idea which is first introduced in the present invention. The shell plate 1 for the supinated foot provided by the present invention allows to correct all kinds of foot shapes which are mainly classified into three basic types so that the mass production for the orthoinserts are possible accordingly.

As the first metatarsus is either in a platarflexed position or a valgus position, the orthoinserts for the supinated feet is one which the first metatarsus accommodative site 12 is formed much lower than compared with other metatarsi in order to make the oversupinated feet to roll-inward to achieve better alignment. The first accommodative site 12 of the insole plate 1 for oversupinating type holds the above part of the first metatarsus and the first cuneiform on its incarved site. Therefore, heel-to-ground alignment can be corrected.

The above 'incarve' means a kind of technique to carve inside a given product, which is well known to those who manufacture the orthoinserts for sports shoes, walking shoes and dress or high-heel shoes.

Further, a cut 13 is formed by removing the site where the first metatarsal head contacts so as to accommodate the site at the right level.

The shell plate 1 for the oversupinated foot may employ both the first inclined site 12 and the cut 13 together.

Figure 6:
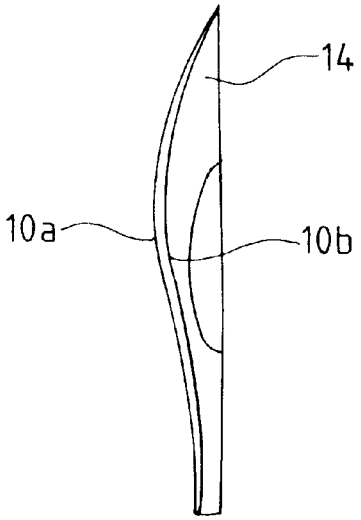
FIG. 6 is a cross-sectional view of the arch height of the orthoinsert shown in FIG. 5.

In contrast, the hyperpronating type shell plate 14 is further characterized in that a skived varus angle site 11 is formed at the heel with a constant inclination following the foot shape and an inverted or counter rotated angle is added around the longitudinal axis of the shell plate so that the forepart of the hyperpronating plate 14 has a higher arch filler 10*a* than the arch filler 10*b* for a semipronation shell plate, as illustrated in FIG. 6.

As described above, it is another characteristic of the present invention that the shell plate 14 for hyperpronating type foot has the skived varus angle site and the inverted angle together, and the formation of the skived varus angle site 11 is known as Kirby's technique which is started by Dr. Kirby and designed for effectively holding the heel aligned with angle ranges of 15 to 40 degrees. However, the usage of only Kirby's method shows that the correction of hyperpronated feet is not always applicable for the adult flat foot which is already too hardened to be corrected.

In addition to this, the formation of the distorted or inverted angle is known as Blake's technique which is initiated by Dr. Blake, wherein the inverted angle is formed around the midfoot so that the forepart and the rearpart of the insole plate 1 are maintained counter rotated in the possible angle ranges of approximately 15 to 45 degree. Again, however, the usage of the Blake's method may not be sufficient for a child's foot which is still soft and too flexible to be corrected.

The present invention is therefore characterized in the new shell plate 14 for the hyperpronated foot by properly adopting both the conventional Kirby's method and the Blake's method and solving the disdavantages of both methods.

As described above, the present invention provides the orthoinserts for foot correction, control and comfort, which are suitable for any type of abnormal foot shapes by setting up the semi pronating type insole plate as a standard to thereby develop the patterned shell plate 1 for the oversupinated foot and shell plate 14 for the hyperpronated foot accordingly.

The present invention also includes a forefoot wedge 15 and a rearfoot wedge 16. They should be attached under the shell plates 1, 14, which have classified and patterned types, for example, over supinating-type, semipronating-type, and hyperpronating-type, and the angle between each of the two wedges to the ground surface is controlled separately.

One end of the forefoot wedge 15 attached on the shell plates has a round-edge finish so as to have a similar shape with the fore part of the shell plates, wherein a plurality of control lines 17 are formed on its surface with each line spaced a constant interval apart longitudinally and the selection of any one of the control lines 17 provides the control of the angle of the fore part of the orthoinserts to the ground surface and the angle can be increased/decreased accordingly for the effective application on the individual foot's functional difference.

The plurality of the control lines 17 formed on the surface of the forefoot wedge 15 can be used as a standard for the angle control of the fore part of the shell to the ground surface, and each control line represents 1 degree difference.

However, the angle size which is controlled by the control lines 17 and the number of the control lines 17 can be varied by those skilled in these related arts by using theory or trial and error counting. Therefore, the present invention should not be confined to the number of the control lines 17 or the controlled angle size.

By the above angle control line 17 of the forefoot wedge 15, the angle range of orthoinserts to the ground surface can be adjusted from 0.5 to 10 degree, and preferably 2 to 3 degree.

One end of the rearfoot wedge 16 attached on the orthoinserts has round-edge finish so as to have a similar shape with the rear part of the orthoinserts, wherein a plurality of control lines 17 are formed on the surface of its rear part with each spaced a constant interval apart along the shape of the heel so that a selection of any one of the control lines provides the control of the angle of the rear part of the orthoinserts to the ground surface. By the above control line of the rearfoot wedge 16, the angle range of the insole plate 1 to the ground surface can be adjusted from 0.5 to 10 degrees, and preferably 2 to 3 degrees.

However, the rear foot wedge 16 can have a wider dimension than the forefoot wedge 15, which is due to the fact that the rear part of the foot or heel carries most of the body weight. The oversupinating heel is everted while the forepart of the foot is controlled by five metatarsals and phalanges.

The control lines 17 of the rearfoot wedge 16 preferably are composed of arcs having the same diameter as the corner of the rearfoot wedge 16, which is understood to make a precise control of the angle by attaching the rearfoot wedge 16 on the rear part of the shell plate 1 and then cutting the extending part out of the wedge.

Therefore, it is first necessary to choose one type of orthoinsert suitable for a certain foot shape for correction which is classified and patterned of three types, such as, oversupinating-type, semipronating-type, and hyperpronating-type, and then to use one or both of the forefoot wedge 15 and the rearfoot wedge 16, which is suitable to control the minute difference among individuals for the easy and convenient application of orthoinserts into a pair of sport shoes or walking shoes.

Orthoinserts for the foot correction and comfort of the present invention can be either applied between the middle insole and the bottom insole of a shoe or attached on the middle insole to be integrated together so that the usage of the shoe having the orthoinsert provides the improved activity and the effective correction of the foot.

Therefore, by the present invention, there is provided an orthoinsert including the control lines 17 formed on the forefoot wedge 15 and the rearfoot wedge 16, wherein the angle between the distorted foot and the ground surface is easily controlled by appropriately selecting the control lines 17 depending on the mechanical condition for any type of abnormal functioning foot and a mass production is possible accordingly.

It will be apparent to those skilled in the art that some modifications and variations of the present invention can be made without departing from the spirit or scope of the invention. Thus, it is intended that the present invention cover the modifications and variations of this invention provided they come within the scope of the appended claims and their equivalents.

What is claimed is:

1. An orthoinsert comprising:

an insole plate which has a length corresponding to the length of heel-to-metatarsal head, wherein an arch filler corresponding to the arch of foot, and a heel site for holding the heel of foot are formed in the plate, the insole having an undersurface, a forefoot wedge attached on a right fore part of the undersurface of the insole plate to control the angle of the forefoot to the ground surface, and a rearfoot wedge attached on a right rear part of the undersurface of the insole plate to control the angle of the rearfoot to the ground surface, wherein said insole plate, said arch filler, and said heel site are integrated, wherein the insole plate has a classified and preformed shape for a hyperpronated foot and the insole plate for a hyperpronated foot includes a medially inskived varus angle site which is formed on the heel site with a constant inclination angle, and a combined distorted angle with said inskived varus angle on the heel, so that a fore part of said insole having said arch filler has a constant angle to said heel site.

2. The orthoinsert as claimed in claim 1, wherein one end of each of said wedges is round-edge finished so as to have a similar shape with said plate, and control lines on the plate for positioning said wedges spaced a constant interval apart so that the selection of any one of said control lines provides control of the angle of the plate to the ground surface.

3. The orthoinsert as claimed in claim 2, wherein said forefoot wedge and said rearfoot wedge are adjustable by said control lines with the angle range of each of said forepart and said rear part of said insole plate to the ground surface from 0.5 to 10 degrees.

* * * * *